US008853622B2

(12) United States Patent
Senko

(10) Patent No.: US 8,853,622 B2
(45) Date of Patent: Oct. 7, 2014

(54) TANDEM MASS SPECTROMETER

(75) Inventor: Michael W. Senko, Sunnyvale, CA (US)

(73) Assignee: Thermo Finnigan LLC, San Jose, CA (US)

( * ) Notice: Subject to any disclaimer, the term of this patent is extended or adjusted under 35 U.S.C. 154(b) by 1989 days.

(21) Appl. No.: 11/703,898

(22) Filed: Feb. 7, 2007

(65) Prior Publication Data

US 2008/0185511 A1 Aug. 7, 2008

(51) Int. Cl.
*H01J 49/00* (2006.01)
*H01J 49/42* (2006.01)

(52) U.S. Cl.
CPC ..... *H01J 49/423* (2013.01); *H01J 49/004* (2013.01)
USPC ..... 250/283; 250/281; 250/282

(58) Field of Classification Search
USPC ..... 250/281, 282, 283, 287, 288, 289, 290, 250/284, 286, 292, 293
See application file for complete search history.

(56) References Cited

U.S. PATENT DOCUMENTS

| | | | | |
|---|---|---|---|---|
| 5,420,425 | A | 5/1995 | Bier et al. | |
| 5,763,878 | A | 6/1998 | Franzen | |
| 6,770,871 | B1 | 8/2004 | Wang et al. | |
| 6,872,938 | B2 | 3/2005 | Makarov et al. | |
| 7,060,972 | B2 * | 6/2006 | Hager | 250/282 |
| 2005/0121609 | A1 * | 6/2005 | Makarov et al. | 250/290 |
| 2006/0016979 | A1 * | 1/2006 | Yang et al. | 250/288 |
| 2006/0163472 | A1 * | 7/2006 | Marquette | 250/290 |
| 2007/0176090 | A1 * | 8/2007 | Verentchikov | 250/287 |
| 2008/0224033 | A1 * | 9/2008 | Makarov | 250/287 |

FOREIGN PATENT DOCUMENTS

| | | | | |
|---|---|---|---|---|
| WO | WO 00/73750 | * | 12/2000 | G01J 3/00 |
| WO | WO 00/73750 | A2 | 12/2000 | |
| WO | WO 2004/083805 | * | 9/2004 | |
| WO | WO 2004/083805 | A2 | 9/2004 | |

* cited by examiner

*Primary Examiner* — Nicole Ippolito
(74) *Attorney, Agent, or Firm* — Charles B. Katz

(57) ABSTRACT

A tandem mass spectrometer includes a two-dimensional ion trap that has an elongated ion-trapping region extending along a continuously curving path between first and second opposite ends thereof. The elongated trapping region has a central axis that is defined substantially parallel to the curved path and that extends between the first and second opposite ends. The two-dimensional ion trap is configured for receiving ions through the first end and for mass selectively ejecting the ions along a direction that is orthogonal to the central axis, such that the ejected ions are directed generally toward a common point. The tandem mass spectrometer also includes a collision cell having an ion inlet that is disposed about the common point for receiving the ions that are ejected therefrom and for causing at least a portion of the ions to undergo collisions and form product ions by fragmentation. A mass analyzer in communication with the collision cell receives the product ions from the collision cell and obtains product ion mass spectra with a rapid scan rate. In this way, a plurality of product ion spectra may be obtained for a large number of precursor ions in a sample without the need for data-dependent operation.

21 Claims, 6 Drawing Sheets

TANDEM MASS SPECTROMETER

FIELD OF THE INVENTION

The instant invention relates generally to the field of mass spectrometry, and more particularly to an apparatus and method for data-independent tandem mass spectrometry, or "all mass" MS/MS.

BACKGROUND OF THE INVENTION

In a simple mass spectrometry (MS) system, ions of a sample are formed in an ion source, such as for instance an Electron Impact (EI) source or an Atmospheric Pressure Ionization (API) source. The ions then pass through a mass analyzer, such as for instance a quadrupole (Q) or a time of flight (TOF) device, for detection. The detected ions include at least one of molecular ions, fragments of the molecular ions, and fragments of other fragment ions.

Tandem mass spectrometry (MS/MS) systems have also been developed, which are characterized by having two or more sequential stages of mass analysis and an intermediate ion fragmentation region, where ions from the first stage are fragmented into product ions for analysis within the second stage. There are two basic types of tandem mass spectrometers, namely those that are "tandem in space" and those that are "tandem in time." Tandem in space mass spectrometers, such as for instance triple quadrupole (QqQ) and quadrupole-time of flight (Q-TOF) devices, have two distinct mass analyzers, one for precursor ion selection and one for product ion detection and/or measurement. An ion fragmentation device, such as for instance a gas-filled collision cell, is disposed between the two mass analyzers for receiving ions from the first mass analyzer and for fragmenting the ions to form product ions for introduction into the second mass analyzer. Tandem in time instruments, on the other hand, have one mass analyzer that analyses both the precursor ions and the product ions, but that does so sequentially in time. Ion trap and FT-ICR are two common types of mass spectrometer that are used for tandem in time MS/MS.

Several MS/MS scan types, in particular "product ion scan", "precursor ion scan" and "neutral loss scan," are known. Performing a "product ion scan" is done by selecting a particular precursor ion in the first MS stage, and then obtaining in the second MS stage a full scan of the product ions that are formed when the selected precursor ion is fragmented. This method is useful for determining structural information relating to a precursor ion of known molecular weight. For instance, two distinct precursor ions of similar molecular weight but different structure can be differentiated based on the product ions they typically fragment into. A "product ion scan" is often used in combination with liquid chromatography (LC-MS/MS). The product ion scan is considered to be data dependent when the mass spectral precursor is automatically selected based upon a previous scan acquired without fragmentation. The mass analyzer then makes a full scan of the product ions resulting from fragmentation of the selected precursor ion of interest.

A "precursor scan," is a method that has a fixed product ion selection for the second MS stage, while using the first MS stage to scan all of the pre-fragmentation precursor ions in a sample. Detection is limited to only those molecules/compounds in the sample that produce a specific product ion when fragmented.

Finally, "neutral loss scan" is a method that supports detection of all precursor ions that lose a particular mass during fragmentation. The second stage mass analyzer scans the ions together with the first stage mass analyzer, but with a predetermined offset corresponding to the lost mass. Neutral loss scans are used for screening experiments, where a group of compounds all give the same mass loss during fragmentation.

Each of the above-mentioned tandem scan types represents a compromise approach, in which the amount of information that is obtained from a sample is balanced against the various limitations of the mass analysis and/or separation systems. In particular, each scan type provides only partial two-dimensional mass spectral (2DMS) data. True 2DMS (also referred to as "all mass MS/MS") requires a data independent approach, in which substantially all of the ions (or all of the ions within a particular mass range of interest) that are produced from a sample are subjected to fragmentation and product ion scanning. Accordingly, a complete two-dimensional MS/MS map comprises product ion mass spectral information for every precursor ion in a sample. The different MS/MS scans such as "product ion scan", "precursor ion scan" and "neutral loss scan" are all subsets of this complete two-dimensional MS/MS map.

Rapidly emerging fields such as proteomics and metabolomics are straining the capabilities of modem, data dependent MS/MS systems. Analysis of complex mixtures is typical, which often involves a liquid chromatography pre-separation step that is followed by one or more MS/MS scan events. Unfortunately, in a LC-MS/MS system the precursor ions duration time is limited because additional peaks elute from the LC device in a specified time period. Normally, there is not enough time to do different types of scans in a single LC run. It is also not unusual that several precursor ions co-elute at the same time. Simply put, in many cases, there is insufficient time to fully analyze all precursor ions using data dependent scan methods. For this reason, acquisition of true two-dimensional data is desirable, which would then allow simple data mining for the extraction of "precursor," "product," and "neutral loss" information.

One approach is to use an ion trap as the first mass analyzer for storing precursor ions and/or accumulating precursor ions over time. By scanning the precursor ions out of the ion trap in a mass selective fashion, it is possible to obtain product ion scans for each precursor ion using a second, rapid scanning mass analyzer such as for instance a TOF. A problem is that there is a conflict between speed of analysis (i.e. number of MS/MS experiments per second) and space charge effects. To ensure that the TOF mass analyzer detects a sufficient number of fragmented ions to give sound experimental data, ever-increasing ion abundances must be stored upstream, particularly where more than one precursor ion is to be fragmented and analyzed. The need for high ion abundances upstream in the first analyzer is in conflict with the fact that the greater the ion abundance, the worse the resolution and accuracy of this analyzer becomes due to space charge effects. For emerging high-throughput applications such as proteomics and metabolomics, it is important to provide heretofore-unattainable speeds of analysis, on the order of hundreds of MS/MS spectra per second. This in turn requires both efficient, space-charge tolerant utilization of the incoming ions and fast, on the order of milliseconds, analysis of the products of each individual precursor m/z.

In U.S. Pat. No. 6,770,871, issued Aug. 3, 2004 to Wang et al., there is described a tandem mass spectrometer including two mass analyzers, with an ion fragmentation device interposed between the two mass analyzers. The first mass analyzer is a non-destructive mass analyzer, such as an ion trap, to initially collect and hold precursor ions and sequentially release precursor ions of known mass to charge ratio. The released precursor ions pass through the fragmentation device, such as a collision cell, where the precursor ions are fragmented into product ions. These product ions then pass on to the second mass analyzer. The second mass analyzer is of a high-speed, full spectrum type, such as a time of flight analyzer, so that a full spectrum of mass data is provided for the product ions, to go with precursor ion mass spectrum data from the first mass analyzer. The primary disadvantage of this design is that the three-dimensional ion trap has insufficient ion storage capacity to produce high quality MS/MS spectra for more than a couple of components at one time. This disadvantage severely restricts the potential performance when operating in true 2DMS mode. Wang et al. suggest the use of a linear ion trap, but positively state a preference for the three dimensional type.

In PCT Publication No. WO 2004/083805, Makarov et al. describe a tandem mass spectrometer including a linear ion trap and an orthogonal acceleration time of flight analyzer (oa-TOF), with a specially designed planar collision cell disposed between the two mass analyzers. In particular, the linear ion trap is operated in radial ejection mode, such that precursor ions stored within the trap are scanned out through a slit-shaped opening in one of the electrodes or between electrodes, to produce a ribbon shaped beam of ions for injection into the collision cell. Advantageously, the linear ion trap is capable of storing a greater number of ions compared to the three-dimensional ion trap. However, because the ion beam is spread out laterally, it cannot be directly injected into a conventional TOF analyzer. Accordingly, the collision cell has been adapted to a planar form to capture the ribbon shaped ion beam from the linear trap, dissociate the ions, and then laterally focus the beam to a narrow circular cross section for optimal injection into the oa-TOF. This is a highly complex and non-standard collision cell design, both from a mechanical and from an electrical design point of view. Furthermore, the inlet end of the planar collision cell has a large cross-sectional area to accept the ribbon shaped ion beam, which would produce a large load on the pumping system from the collision gas that would leak from this orifice. This load could be sufficiently large to require differential pumping around the collision cell, adding to the overall complexity of the system.

There remains a need in the mass spectrometry art for a system and method that supports data independent tandem MS/MS of complex samples while avoiding the problems and complexities of the approaches outlined above.

SUMMARY OF THE INVENTION

According to an aspect of the instant invention there is provided a tandem mass spectrometer comprising: a collision cell comprising an ion inlet for receiving ions, the collision cell having a collision gas in its interior for causing at least a portion of the ions to undergo collisions and to form product ions by fragmentation; a two-dimensional ion trap comprising a trapping region including an ion entrance for receiving ions having a mass-to-charge ratio within a first range of values, the ion trap being operable to mass-selectively eject, through an ion exit, ions having a mass-to-charge ratio within a second range of values that is narrower than the first range of values, the trapping region being curved concavely toward the ion inlet of the collision cell for focusing ejected ions toward the ion inlet of the collision cell; and, a mass analyzer in communication with the collision cell for receiving the product ions therefrom and for generating product ion mass spectra.

According to an aspect of the instant invention, there is provided a tandem mass spectrometer comprising: a two-dimensional ion trap comprising an elongated ion trapping region extending along a continuously curving path between first and second opposite ends thereof, the elongated trapping region having a central axis that is defined substantially parallel to the curved path and that extends between the first and second opposite ends, the two-dimensional ion trap configured for receiving ions through the first end and for mass selectively ejecting the ions along a direction that is orthogonal to the central axis such that the ejected ions are directed generally toward a common point; a collision cell including an ion inlet that is disposed about the common point for receiving the ions that are ejected from the ion trap, the collision cell for inducing at least a portion of the ions to undergo collisions with a background gas and to form product ions by fragmentation; and, a mass analyzer in communication with the collision cell for receiving the product ions therefrom and for generating product ion mass spectra.

According to an aspect of the instant invention, there is provided is a method comprising: a) storing ions having a mass-to-charge ratio within a first range of values within a two-dimensional ion trap having a curved trapping region extending between two opposite ends thereof; b) mass selectively ejecting from the two-dimensional ion trap, ions having a mass-to-charge ratio within a second range of values that is narrower than the first range of values, such that the ejected ions propagate along a plurality of different trajectories, each different trajectory originating within the curved trapping region and between the two opposite ends thereof, and each trajectory being directed generally toward an ion inlet of a collision cell that is disposed adjacent to the two-dimensional ion trap; c) collisionally dissociating at least a portion of the ejected ions within the collision cell, so as to produce product ions; and, d) using a mass analyzer, obtaining a mass spectrum of the product ions.

BRIEF DESCRIPTION OF THE DRAWINGS

Exemplary embodiments of the invention will now be described in conjunction with the following drawings, in which similar reference numerals designate similar items.

DESCRIPTION OF PREFERRED EMBODIMENTS

The following description is presented to enable a person of skill in the art to make and use the invention, and is provided in the context of a particular application and its requirements. Various modifications to the disclosed embodiments will be readily apparent to a person of skill in the art, and the general principles defined herein may be applied to other embodiments and applications without departing from the spirit and the scope of the invention. Thus, the present invention is not intended to be limited to the embodiments disclosed, but is to be accorded the widest scope consistent with the principles and features disclosed herein.

According to at least one embodiment of the instant invention a two-dimensional ion trap having a curved trapping region is disposed before the collision cell of a tandem mass spectrometer. The two-dimensional ion trap has an "enlarged" or "elongated" ion occupied volume compared to a three-dimensional ion trap. The increase in volume allows for the trapping of more ions at the same charge density without a corresponding increase in space charge. Trapping more ions improves the signal-to-noise ratio, sensitivity, and dynamic range.

Figure 1:
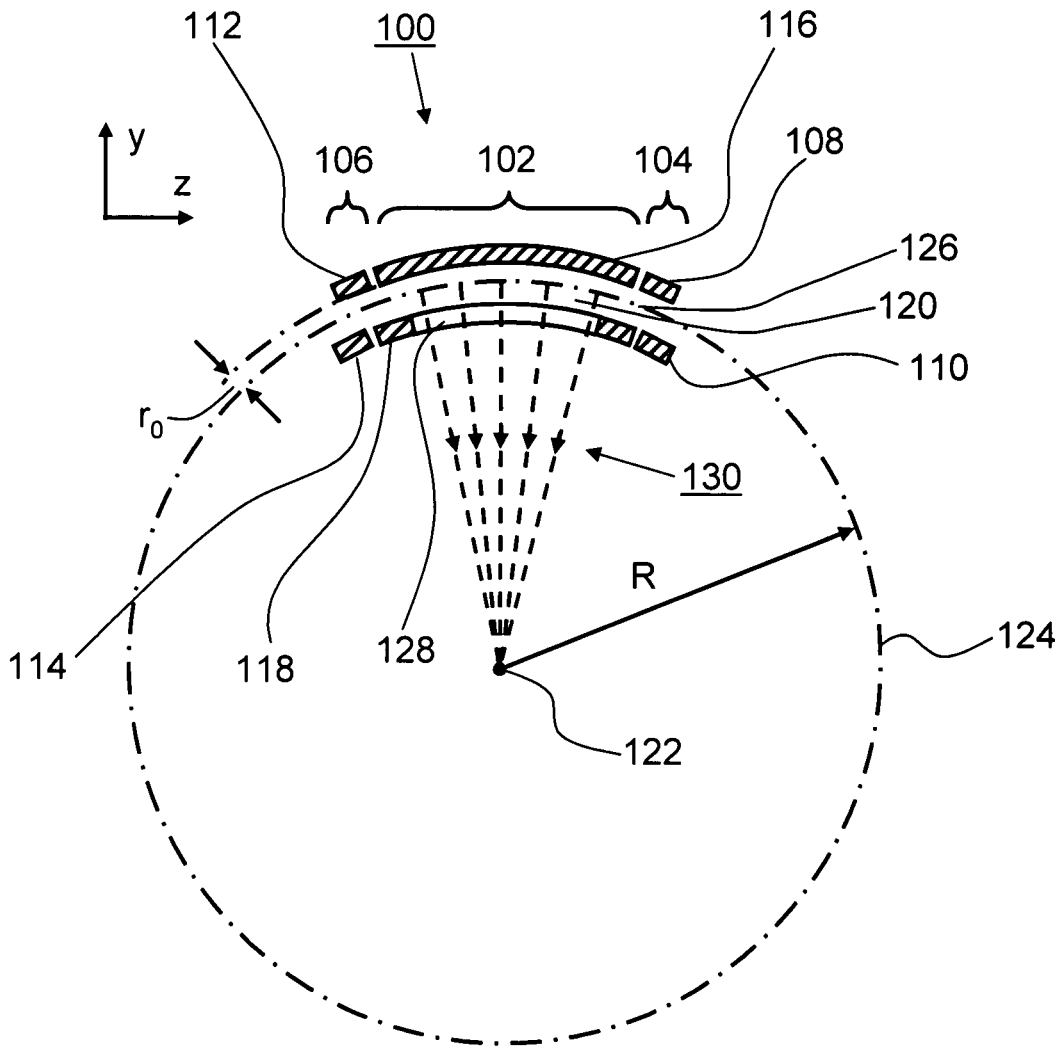
FIG. 1 is a simplified cross sectional diagram taken in the y-z plane and showing a two-dimensional, substantially quadrupole ion trap with a curved ion trapping region.

FIG. 1 is a simplified cross sectional diagram taken in the y-z plane and showing a curved two-dimensional, substantially quadrupole ion trap, as described in more detail by Bier et al. in U.S. Pat. No. 5,420,425, the entire contents of which is incorporated herein by reference. The two-dimensional ion trap 100 is shown with three sections: a central section 102, and two end sections 104 and 106. In the instant example, each section includes two pairs of opposing electrodes. For rear end section 104, y-axis electrodes 108 and 110 are positioned and spaced opposite each other; additional not illustrated x-axis electrodes are similarly positioned and spaced opposite each other. Entrance end section 106 has y-axis opposing electrodes 112 and 114; additional not illustrated x-axis electrodes are similarly positioned and spaced opposite each other. Central section 102 has y-axis opposing electrodes 116 and 118; additional not illustrated x-axis electrodes are similarly positioned and spaced opposite each other. The end-to-end arrangement of sections 102, 104 and 106 produces an elongated and enlarged trapping region 120 for trapping ions within the central section 102. Because the electrodes are curved in a common direction, it follows that the trapping region 120 is also curved. As shown in FIG. 1, the trapping region 120 is curved concavely toward the center of curvature 122 of a best-fit circle 124 having a radius of R.

Referring still to FIG. 1, the two-dimensional ion trap 100 has a center axis 126, which is defined as a line that is located substantially along the center of the ion-occupied volume. This line coincides generally with a similar line along the center of the trapping region 120, such that the center axis 126 is approximately the locus of points equidistant from the apices of opposing electrodes.

The entrance end section 106 can be used to gate ions into the two-dimensional ion trap 100. During use, the two end sections 104 and 106 differ in potential from the central section 102 such that a "potential well" is formed in the central section 102 to trap the ions. An elongated aperture 128, which lies in the y-z plane, allows the trapped ions to be mass-selectively ejected (in the mass selective instability scan or resonant excitation mode) in the direction of the arrows shown generally at 130. In other words, the ions are ejected in a direction that is orthogonal to the center axis 126.

A damping gas, such as helium (He) or hydrogen ($H_2$), at pressures near $1\times10^{-3}$ torr, results in collisional cooling of the ions within the two-dimensional ion trap 100. In general, the overall trapping and storage efficiency of the two-dimensional ion trap 100 filled with helium or hydrogen is increased due to collisional cooling while trapping the ions. Optionally, the ions are ejected between the electrodes of the two-dimensional ion trap 100 in the direction indicated by the arrows shown generally at 130 by applying phase synchronized resonance ejection fields to both pairs of rods at, for example, $\beta_x$=0.3, $\beta_z$=0.3. An aperture in the electrode structures would not be required in this case. Further optionally, the end sections 104 and/or 106 are provided in the form of plates or other conductive lenses, one of which has an aperture, with the appropriate DC voltages applied to the plates to create a potential well that keeps the ions trapped in the central section 102.

The curved two-dimensional ion trap 100 also is known to suffer somewhat from poor mass accuracy and resolution relative to a linear two-dimensional ion trap, but provides the benefit of focusing the ions that are ejected therefrom to a point for optimal injection into subsequent stages. In addition, the curved two-dimensional ion trap has an increased ion storage capacity compared to a three-dimensional ion trap under similar space charge conditions. For the 2DMS experiment, what is most critical is the storage capacity, with mass scanning capabilities being secondary. The two-dimensional ion trap mass selectively ejects ions for the purpose of separating the precursor ions one from another, not for generation of the full mass spectrum. Mass resolution greater than the spacing of adjacent precursors is, strictly speaking, excessive.

The substantially quadrupole two-dimensional ion trap that is shown in FIG. 1 is intended to serve as a specific and non-limiting example, and is presented for the purpose of aiding in the understanding of the principles that are described herein. That being said, other multipole structures may optionally be used to form a two-dimensional ion trap having a curved ion trapping region, such that ions ejected therefrom are directed generally toward a common point. In particular, the two-dimensional ion trap 100 optionally is provided in the form of a substantially hexapole two-dimensional ion trap or in the form of a substantially octapole two-dimensional ion trap.

Figure 2:
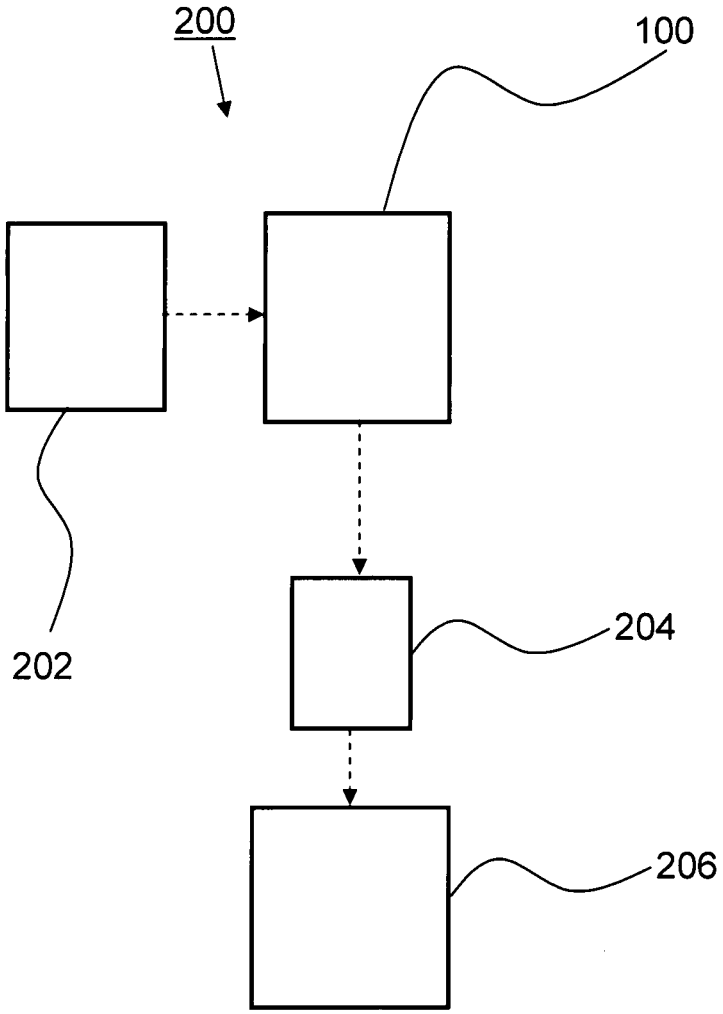
FIG. 2 is a simplified block diagram showing a tandem mass spectrometer according to an embodiment of the instant invention.

Referring now to FIG. 2, shown is a simplified block diagram of a tandem mass spectrometer according to an embodiment of the instant invention, wherein dotted lines indicate the general direction of ion propagation. The tandem mass spectrometer 200 includes an ionization region 202 for producing ions from a sample, a two-dimensional ion trap 100 with a curved trapping region for storing and/or accumulating ions, a collision cell 204 for fragmenting ions to form product ions, and a mass analysis region 206 for obtaining mass spectral data relating to the product ions.

During use, ions propagate along a first direction between the ionization region 202 and the two-dimensional ion trap 100. The ions are ejected from the two-dimensional ion trap 100 in a mass selective fashion, such that the ejected ions travel along a second direction that is substantially orthogonal to the first direction. More specifically, the two-dimensional ion trap 100 includes a curved trapping region with one side being curved concavely toward the collision cell 204. Ions are ejected from the two dimensional-ion trap 100 along a plurality of different trajectories, each trajectory originating within the two-dimensional ion trap 100 and being directed generally toward an ion inlet of the collision cell 204. In effect, the ions are ejected from different locations along the length of the two-dimensional ion trap 100, but because the trapping region is curved, the ejected ions are focused toward a point that is near the ion inlet of collision cell 204. Since the ejected ions are focused to a narrow cross section, the collision cell 204 is conveniently of conventional design and the ion inlet orifice is dimensioned such that the load on the pumping system from the collision gas is relatively small. At least a portion of the ions undergo collisions with a collision gas inside the collision cell 204 and acquire sufficient internal energy to dissociate into product ions. The product ions are passed from the collision cell 204 to mass analysis region 206 for mass spectral analysis and detection. In particular, the mass analysis region includes a mass analyzer and detector system that is capable of acquiring one or more complete spectra of the product ions for each precursor ion that is scanned out of the two-dimensional ion trap. Furthermore, the tandem mass spectrometer of FIG. 2 includes a not illustrated data acquisition system for acquiring, organizing, storing and/or displaying the 2DMS data.

Figure 3:
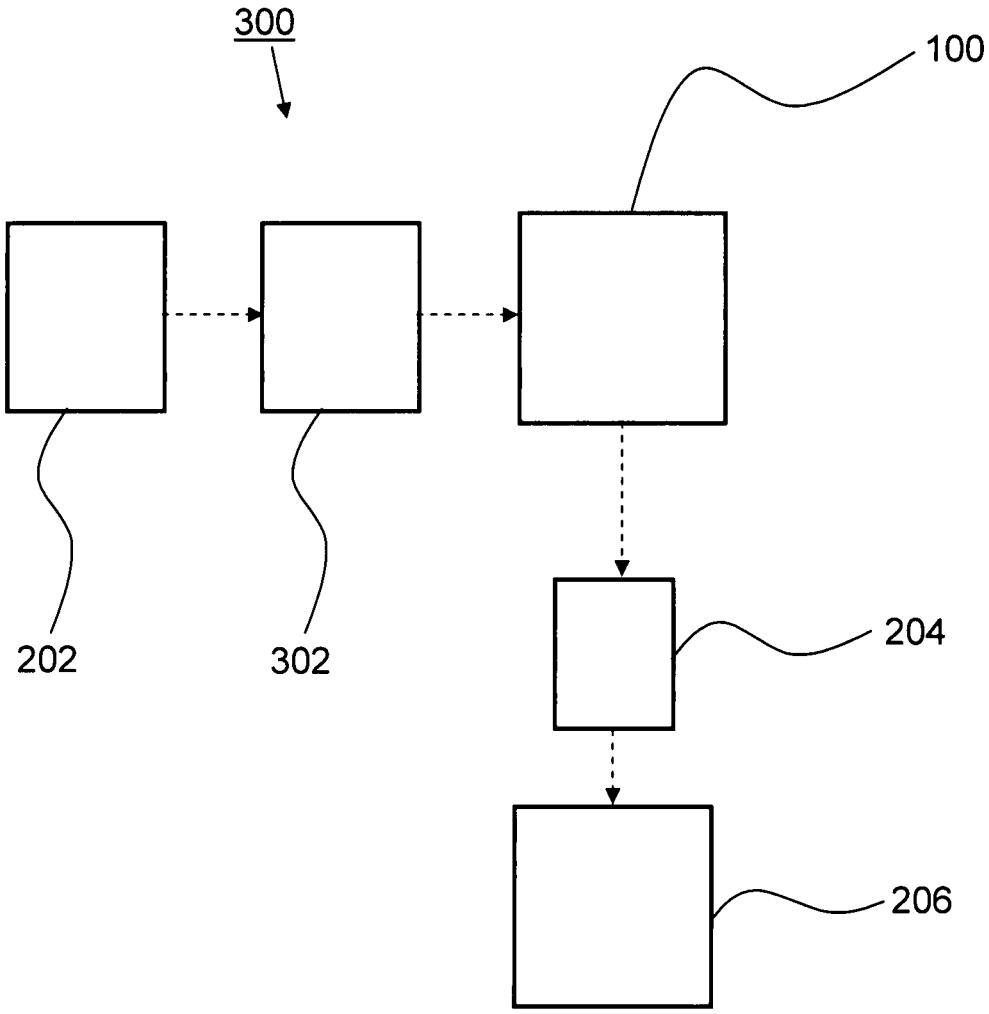
FIG. 3 is a simplified block diagram showing a tandem mass spectrometer according to an embodiment of the instant invention.

Referring now to FIG. 3, shown is a simplified block diagram of a tandem mass spectrometer according to an embodiment of the instant invention, wherein dotted lines indicate the general direction of ion propagation. The tandem mass spectrometer 300 includes an ionization region 202 for producing ions from a sample, a linear ion trap 302 for obtaining full MS scans, a two-dimensional ion trap 100 with a curved trapping region for storing and/or accumulating ions that are received from the linear ion trap 302, a collision cell 204 for fragmenting ions to form product ions, and a mass analysis region 206 for obtaining mass spectra of the product ions.

During use, ions propagate along a first direction between the ionization region 202 and the linear ion trap 302. To produce a full MS scan, the linear ion trap 302 is filled with about 30,000 (30 k) ions, and ions can be scanned out radially at a rate of about 5,000 atomic mass units (amu, i.e. 5 kamu) per second with a q of 0.88. In this way, about 2 full scans per second are obtained with well resolved peaks. To produce a 2DMS scan, the ions are ejected axially along the first direction from the linear ion trap 302 to the two-dimensional ion trap 100. The ions are then ejected from the two-dimensional ion trap 100 in a mass selective fashion, such that the ejected ions propagate along a second direction that is substantially orthogonal to the first direction. More specifically, the two-dimensional ion trap 100 includes a curved trapping region with one side being curved concavely toward the collision cell 204. Ions are ejected from the two-dimensional ion trap 100 along a plurality of different trajectories, each trajectory originating within the two-dimensional ion trap 100 and being directed generally toward an ion inlet of the collision cell 204. In effect the ions are ejected from different locations along the length of the two-dimensional ion trap 100, but because the trapping region is curved, the ejected ions are focused toward a point that is near the ion inlet of collision cell 204. Since the ejected ions are tightly focused toward a focal point, the collision cell 204 is conveniently of conventional design and the ion inlet orifice is dimensioned such that the load on the pumping system from the collision gas is relatively small. At least a portion of the ions undergo collisions with a collision gas inside the collision cell and acquire sufficient internal energy to dissociate into product ions. The product ions are passed from the collision cell 204 to mass analysis region 206 for mass spectral analysis and detection. In particular, the mass analysis region includes a mass analyzer and detector system that is capable of acquiring one or more complete spectra of the product ions for each precursor ion that is scanned out of the two-dimensional ion trap. Furthermore, the tandem mass spectrometer of FIG. 3 includes a not illustrated data acquisition system for acquiring, organizing, storing and/or displaying the MS data from the linear ion trap 302 and for acquiring, organizing, storing and/or displaying the 2DMS data from the subsequent components.

Figure 4:
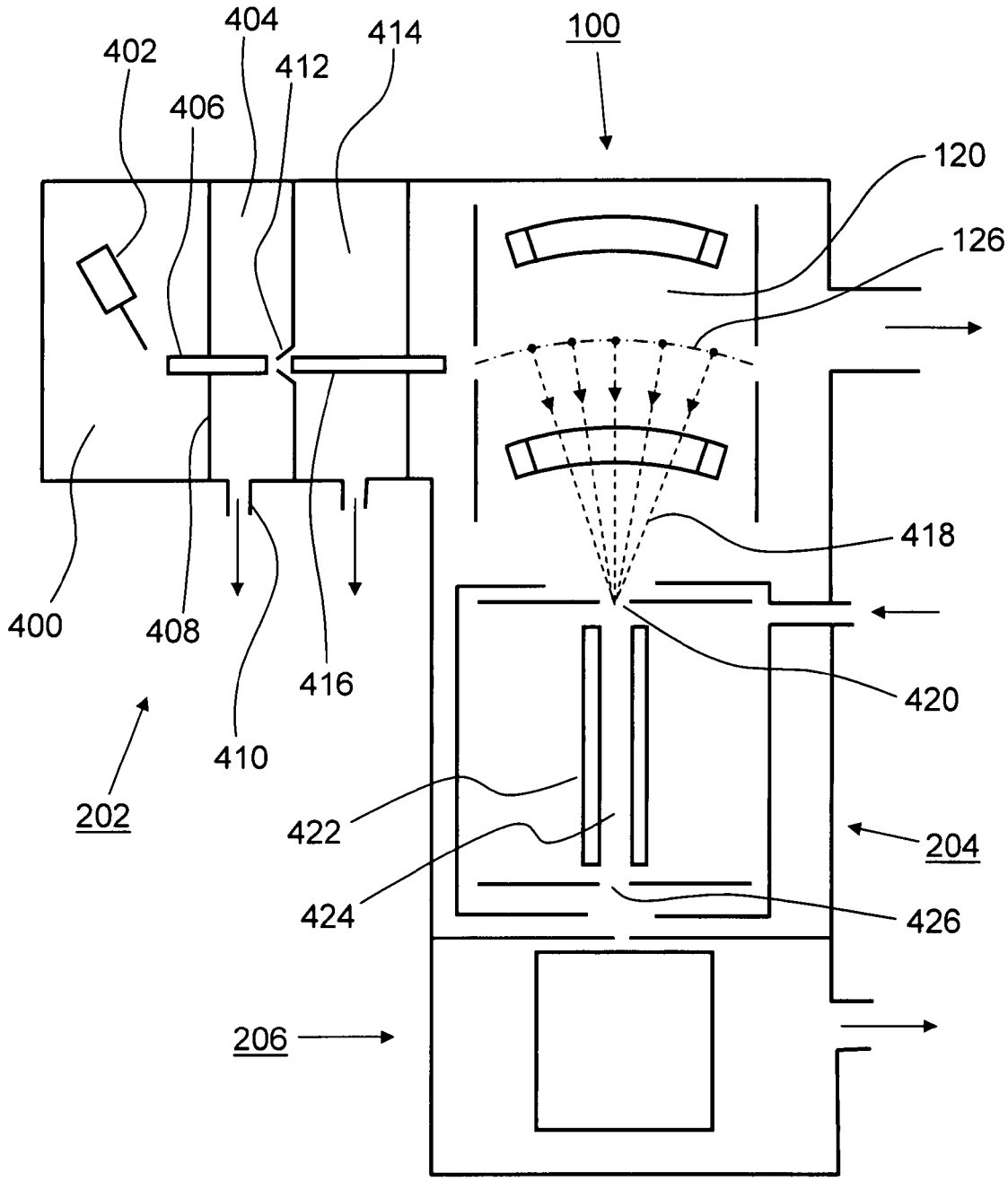
FIG. 4 is a simplified schematic diagram of the tandem mass spectrometer of FIG. 2.

Referring now to FIG. 4, shown is a simplified schematic diagram of the tandem mass spectrometer of FIG. 2. Ions are produced within ionization chamber 400 of the ionization region 202 in a known fashion. By way of a specific and non-limiting example, the ionization chamber 400 includes an atmospheric pressure ionization (API) probe 402, such as for instance an electrospray ionization (ESI) probe. Optionally another type of API probe is provided instead of API probe 402, such as for instance a heated electrospray ionization (H-ESI) probe, an atmospheric pressure chemical ionization (APCI) probe, an atmospheric pressure photoionization (APPI) probe, or an atmospheric pressure laser ionization (APLI) probe. Optionally, a "multi-mode" probe combining a plurality of the above-mentioned probe types is provided. Further optionally, the ionization region 202 employs another ionization technique, such as for instance electron impact ionization.

Continuing the current example, the API probe 402 produces ions within ionization chamber 400. The ions that are produced by the API probe 402 are sampled into a low-pressure chamber 404 via an ion transfer tube 406, which is mounted in a gas-tight fashion through a wall 408 separating ionization chamber 400 from the low-pressure chamber 404. A not illustrated vacuum pump, more specifically a roughing pump, is connected to vacuum port 410. By way of a few non-limiting examples, the not illustrated vacuum pump is one of a rotary vane pump, a roots blower and a scroll pump that is capable of maintaining the low-pressure chamber 404 at a pressure of about 0.1-50 torr. Most of the air, moisture and neutral solvent molecules are pumped away in this stage. Ions pass through a cone shaped skimmer 412 and into the next stage 414, where they are focused and guided by a RF only multi-pole ion guide 416 to the two dimensional ion trap 100.

As described with reference to FIG. 1, the two-dimensional ion trap 100 includes a plurality of electrode sections, each section including a y-axis opposing electrode pair and an x-axis opposing electrode pair. Because the electrodes are curved in a common direction, the trapping region 120 is also curved with the center axis 126 being located approximately equidistant from the apices of opposing electrodes. Ejected ions 418 leave the two-dimensional ion trap 100 through elongated aperture 128, or optionally via a space between two electrodes, in a direction that is orthogonal to the center axis 126. The ions 418 are focused toward ion inlet 420 of collision cell 204.

Collision cell 204 can be any of a variety of means to fragment the ejected ions into product ions. Preferably, the collision cell 204 keeps the ions contained along a path leading to the mass analyzer 206, which may take the form of a TOF analyzer, a two-dimensional quadrupole ion trap, or other suitable device. In the instant example, the collision cell 204 is substantially similar to a collision cell from a triple quadrupole mass filter instrument. Such a collision cell 204 typically includes a RF only multi-pole structure 422. Ions are focused in center region 424 and collide with Argon or another collision gas that fills the collision cell 204. This process is referred to as collision induced dissociation (CID). The kinetic energies of the incoming ions (and consequently the degree and pattern of fragmentation) may be controlled by adjusting a DC offset between the electrodes of ion trap 100 and collision cell 204. The product ions and unfragmented precursor ions passing out of the collision cell 204 through an exit 426 may be focused and cooled by another not illustrated RF only multi-pole ion guide. Optionally, the ions are made to pass through a not illustrated electrostatic lens and ion gate assembly before entering the mass analyzer 206 in order to provide focusing and gating of the ion stream. Further optionally, the collision cell is provided with auxiliary electrodes or other structures to which appropriate voltages are applied in order to generate an axial DC gradient (a "drag field") that assists in transporting ions through the collision cell 204. Still further optionally, the collision cell may be sectioned or provided with an exit lens to allow the generation of a switchable DC barrier for temporary trapping of the ions within the collision cell interior.

The mass analyzer 206 preferably scans (i.e., mass-selectively ejects) the product ions at a rapid rate so that the mass analyzer 206 is ready to scan product ions from the next ion subsequently entering the collision cell. To keep the overall tandem mass spectrometer functioning properly in real time, the mass analyzer 206 preferably scans at least one hundred times faster than the two-dimensional ion trap 100, and preferably at least one thousand times faster. For instance, the mass analyzer 206 is one of a TOF device or a linear ion trap. The mass analyzer 206 preferably scans at a rate of at least 500,000 amu per second and more preferably at least 1,000,000 amu per second. Assuming that it takes 1 msec to inject ions from the collision cell 204 and an additional 2 msec to scan using the mass analyzer 206, the tandem mass spectrometer shown at FIG. 4 supports acquisition of approximately 300 MS/MS scans per second. Accordingly, a typical proteomics mass range of about 400 m/z to 1400 m/z may be covered in 3.3 seconds, a time scale that is substantially compatible with chromatography separations. Optionally, the mass analyzer 206 includes a plurality of two-dimensional ion traps for scanning simultaneously.

Figure 5:
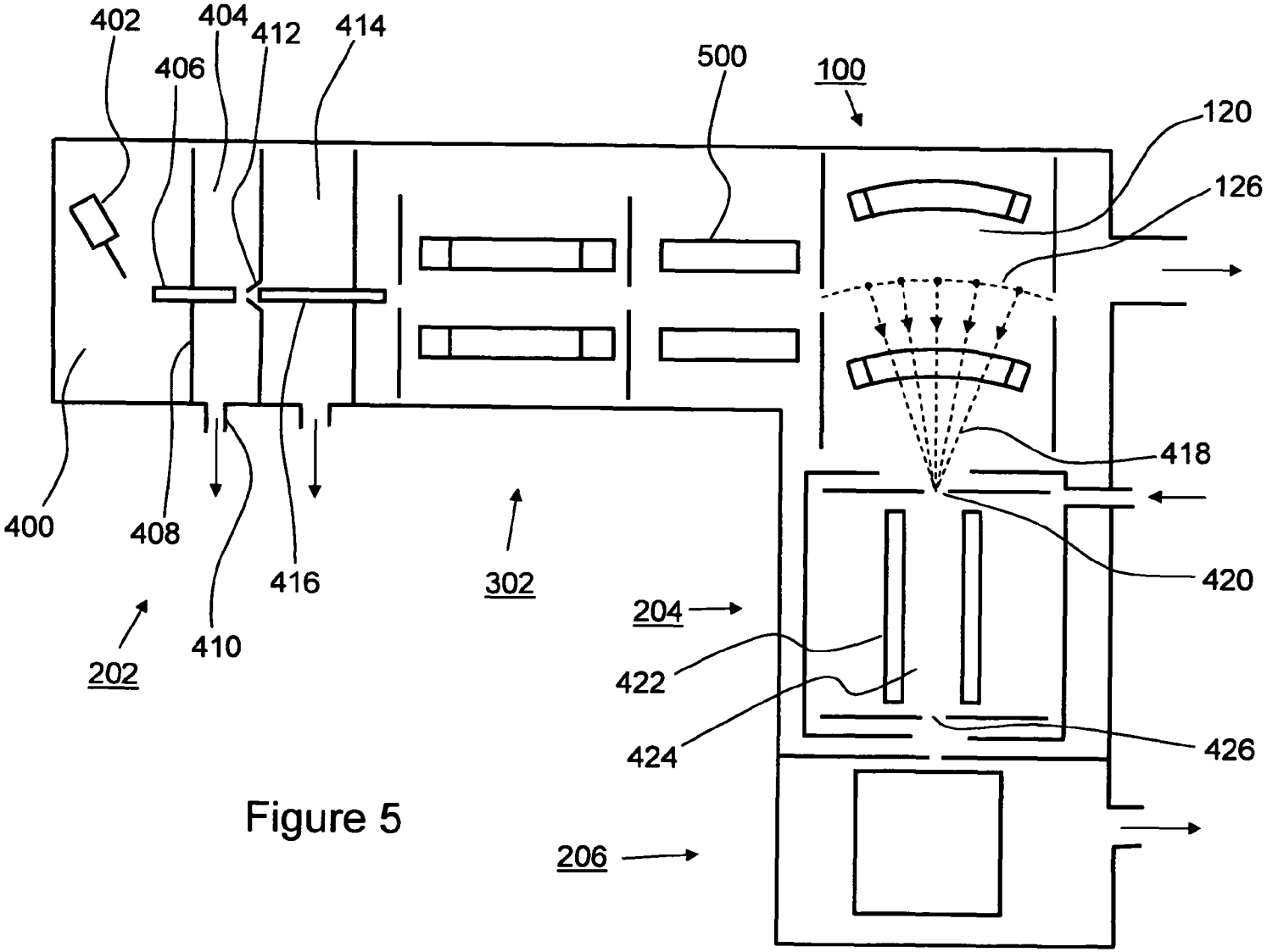
FIG. 5 is a simplified schematic diagram of the tandem mass spectrometer of FIG. 3; and, FIG. 6 is a simplified flow diagram of a method according to an embodiment of the instant invention.

Referring now to FIG. 5, shown is a simplified schematic diagram of the tandem mass spectrometer of FIG. 3. Ions are produced within ionization chamber 400 of the ionization region 202 in a known fashion. By way of a specific and non-limiting example, the ionization chamber 400 includes an atmospheric pressure ionization (API) probe 402, such as for instance an electrospray ionization (ESI) probe. Optionally another type of API probe is provided instead of API probe 402, such as for instance a heated electrospray ionization (H-ESI) probe, an atmospheric pressure chemical ionization (APCI) probe, an atmospheric pressure photoionization (APPI) probe, or an atmospheric pressure laser ionization (APLI) probe. Optionally, a "multi-mode" probe combining a plurality of the above-mentioned probe types is provided. Further optionally, the ionization region 202 employs another ionization technique, such as for instance electron impact ionization.

Continuing the current example, the API probe 402 produces ions within ionization chamber 400. The ions that are produced by the API probe 402 are sampled into a low-pressure chamber 404 via an ion transfer tube 406, which is mounted in a gas-tight fashion through a wall 408 separating ionization chamber 400 from the low-pressure chamber 404. A not illustrated vacuum pump, more specifically a roughing pump, is connected to vacuum port 410. By way of a few non-limiting examples, the not illustrated vacuum pump is one of a rotary vane pump, a roots blower and a scroll pump that is capable of maintaining the low-pressure chamber 404 at a pressure of about 0.1-50 torr. Most of the air, moisture and neutral solvent molecules are pumped away in this stage. Ions pass through a cone shaped skimmer 412 and into the next stage 414, where they are focused and guided by a RF only multi-pole ion guide 416 to the linear ion trap 302. The ions are axially ejected from the linear ion trap 302 and pass through a multipole ion guide 500 to the two-dimensional ion trap 100.

As described with reference to FIG. 1, the two-dimensional ion trap 100 includes a plurality of electrode sections, each section including a y-axis opposing electrode pair and an x-axis opposing electrode pair. Because the electrodes are curved in a common direction, the trapping region 120 is also curved with the center axis 126 being located approximately equidistant from the apices of opposing electrodes. Ejected ions 418 leave the two-dimensional ion trap 100 through elongated aperture 128, or optionally via a space between two electrodes, in a direction that is orthogonal to the center axis 126. The ions 418 are focused toward ion inlet 420 of collision cell 204.

Collision cell 204 can be any of a variety of means to fragment the ejected ions into product ions. Preferably, the collision cell 204 keeps the ions contained along a path leading to the mass analyzer 206, which may take the form of a TOF analyzer, a two-dimensional quadrupole ion trap, or other suitable device. In the instant example, the collision cell 204 is substantially similar to a collision cell from a triple quadrupole mass filter instrument. Such a collision cell 204 typically includes a RF only multi-pole structure 422. Ions are focused in center region 424 and collide with Argon or another collision gas that fills the collision cell 204. This process is referred to as collision induced dissociation (CID). The kinetic energies of the incoming ions (and consequently the degree and pattern of fragmentation) may be controlled by adjusting a DC offset between the electrodes of ion trap 100 and collision cell 204. The product ions and unfragmented precursor ions passing out of the collision cell 204 through an exit 426 may be focused and cooled by another not illustrated RF only multi-pole ion guide. Optionally, the ions are made to pass through a not illustrated electrostatic lens and ion gate assembly before entering the mass analyzer 206 in order to provide focusing and gating of the ion stream. Further optionally, the collision cell is provided with auxiliary electrodes or other structures to which appropriate voltages are applied in order to generate an axial DC gradient (a "drag field") that assists in transporting ions through the collision cell 204. Still further optionally, the collision cell may be sectioned or provided with an exit lens to allow the generation of a switchable DC barrier for temporary trapping of the ions within the collision cell interior.

The mass analyzer 206 preferably scans (i.e., mass-selectively ejects) the product ions at a rapid rate so that the mass analyzer 206 is ready to scan product ions from the next ion subsequently entering the collision cell. To keep the overall tandem mass spectrometer functioning properly in real time, the mass analyzer 206 preferably scans at least one hundred times faster than the two-dimensional ion trap 100, and preferably at least one thousand times faster. For instance, the mass analyzer 206 is one of a TOF device or a linear ion trap. The mass analyzer 206 preferably scans at a rate of at least 500,000 amu per second and more preferably at least 1,000,000 amu per second. Assuming that it takes 1 msec to inject ions from the collision cell 204 and an additional 2 msec to scan using the mass analyzer 206, the tandem mass spectrometer shown at FIG. 4 supports acquisition of approximately 300 MS/MS scans per second. Accordingly, a typical proteomics mass range of about 400 m/z to 1400 m/z may be covered in 3.3 seconds, a time scale that is substantially compatible with chromatography separations. Optionally, the mass analyzer 206 includes a plurality of two-dimensional ion traps for scanning simultaneously.

During use, the linear ion trap 302 is used to acquire full scans whilst the two-dimensional ion trap 100, collision cell 204 and mass analyzer 208 are used to acquire the 2DMS data. For instance, the linear ion trap 302 is operated under normal space charge conditions (about 30,000 ions) and the curved trap is operated under high space charge conditions so as to increase the number of ions for detection during acquisition of the 2DMS data. All though the two-dimensional ion trap 100 is expected to eject ions with space charge shifts, these shifts may be corrected for based upon the full scan data that is collected using the linear ion trap 302.

The use of the linear ion trap 302 also reduces the need to operate the two-dimensional components at a high repetition rate. For instance, in a LC-MS/MS system the chromatographic profile could be acquired and reconstructed using simple MS data from the linear ion trap 302. In particular, it is sufficient that the linear ion trap 302 acquire full scan MS spectra at a rate of one or two Hz, while the two-dimensional data is acquired at about 0.2 Hz. The need for high temporal resolution in the 2DMS data is lessened since the temporal resolution is available from the more rapid full scans. Advantageously, reduction in the acquisition rate of the 2DMS data reduces the size of data files.

Figure 6:
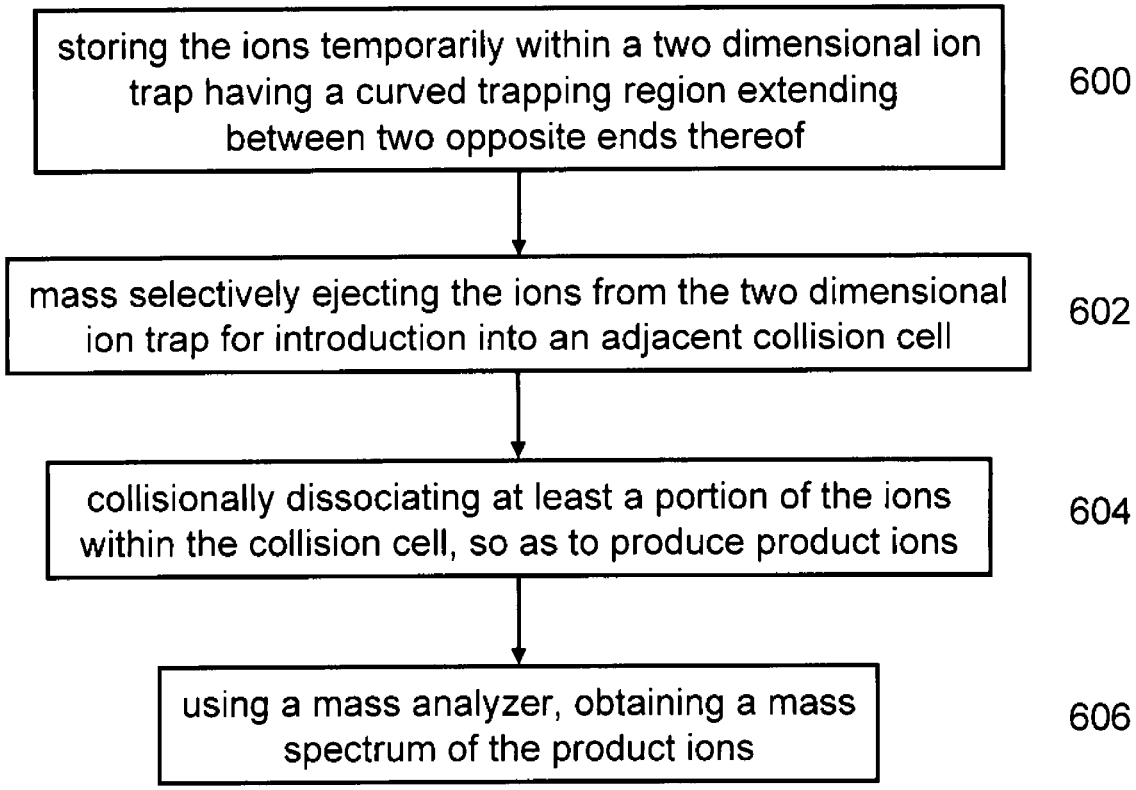

Referring now to FIG. 6, shown is a simplified flow diagram of a method according to an embodiment of the instant invention. At step 600, ions having a mass-to-charge ratio within a first range of values are stored temporarily within a two-dimensional ion trap, which has a curved trapping region extending between two opposite ends thereof. At step 602 ions having a mass-to-charge ratio within a second range of values that is narrower than the first range of values are ejected from the two-dimensional ion trap in a mass selective fashion, such that the ions propagate along a plurality of different trajectories. In particular, each different trajectory originates within the curved trapping region and between the two opposite ends thereof, and each different trajectory is directed generally toward an ion inlet of a collision cell that is disposed adjacent to the two dimensional ion trap. In this way ions of different m/z arrive at the collision cell sequentially, and on a time scale that allows ions of a first m/z value to be collisionally dissociated at step 604 and the resulting product ions passed on to a mass analyzer prior to ions of a second m/z being introduced into the collision cell. At step 606 the mass spectrometer is used to obtain a mass spectrum of the product ions, and preferably several mass spectral scans are obtained and averaged for the product ions. The mass spectral data is retrievably stored in a format that is suitable for performing subsequent analysis.

Numerous other embodiments may be envisaged without departing from the spirit and scope of the invention.

What is claimed is:

1. A tandem mass spectrometer, comprising:

a collision cell comprising an ion inlet for receiving ions, the collision cell having a collision gas in its interior during operation of the mass spectrometer for causing at least a portion of the ions to undergo collisions and to form product ions by fragmentation;

a two-dimensional ion trap comprising a trapping region including an ion entrance for receiving ions having a mass-to-charge ratio within a first range of values, the ion trap being operable to mass-selectively eject, through an ion exit, ions having a mass-to-charge ratio within a second range of values that is narrower than the first range of values, the trapping region being curved concavely toward the ion inlet of the collision cell for focusing ejected ions toward the ion inlet of the collision cell; and, a mass analyzer in communication with the collision cell for receiving the product ions therefrom and for generating product ion mass spectra.

2. A tandem mass spectrometer according to claim 1, wherein the two-dimensional ion trap comprises a plurality of elongated electrodes that are curved in a direction transverse to the direction of elongation, so as to define therebetween the trapping region that is curved concavely toward the ion inlet of the collision cell.

3. A tandem mass spectrometer according to claim 1, comprising an ion source in communication with the two-dimensional ion trap for providing ions thereto.

4. A tandem mass spectrometer according to claim 3, comprising a linear ion trap disposed between the ion source and the two-dimensional ion trap.

5. A tandem mass spectrometer according to claim 1, wherein the mass analyzer comprises a linear ion trap.

6. A tandem mass spectrometer according to claim 1, wherein the mass analyzer comprises a time of flight mass analyzer.

7. A tandem mass spectrometer according to claim 1, wherein the ion exit is disposed on a side of the curved trapping region that is nearest a center of curvature of the two-dimensional ion trap.

8. A tandem mass spectrometer according to claim 7, wherein the ion exit is elongated in the direction of curvature so as to form a generally slit-shaped orifice, such that during use the ions are ejected from the curved trapping region along a plurality of different trajectories that are directed generally toward the center of curvature.

9. A tandem mass spectrometer according to claim 1, wherein the mass analyzer scans at a rate of at least 500,000 amu per second.

10. A tandem mass spectrometer according to claim 1, wherein the mass analyzer scans at a rate of at least 1,000,000 amu per second.

11. A tandem mass spectrometer, comprising:

a two-dimensional ion trap comprising an elongated ion trapping region extending along a continuously curving path between first and second opposite ends thereof, the elongated trapping region having a central axis that is defined substantially parallel to the curved path and that extends between the first and second opposite ends, the two-dimensional ion trap configured for receiving ions through the first end and for mass selectively ejecting the ions along a direction that is orthogonal to the central axis such that the ejected ions are directed generally toward a common point;

a collision cell including an ion inlet that is disposed about the common point for receiving the ions that are ejected from the two-dimensional ion trap, the collision cell for inducing at least a portion of the ions to undergo collisions with a background gas and to form product ions by fragmentation; and, a mass analyzer in communication with the collision cell for receiving the product ions therefrom and for generating product ion mass spectra.

12. A tandem mass spectrometer according to claim 11, wherein the mass analyzer scans at a rate of at least 500,000 amu per second.

13. A tandem mass spectrometer according to claim 11, wherein the mass analyzer scans at a rate of at least 1,000,000 amu per second.

14. A tandem mass spectrometer according to claim 11, wherein the mass analyzer comprises a linear ion trap.

15. A tandem mass spectrometer according to claim 11, wherein the mass analyzer comprises a time of flight mass analyzer.

16. A tandem mass spectrometer according to claim 11, comprising an ion source in communication with first end of the two-dimensional ion trap for providing ions thereto.

17. A tandem mass spectrometer according to claim 16, comprising a linear ion trap disposed between the ion source and the first end of the two-dimensional ion trap.

18. A method of mass analyzing ions, comprising:

a) storing ions having a mass-to-charge ratio within a first range of values within a two-dimensional ion trap having a curved trapping region extending between two opposite ends thereof;

b) mass selectively ejecting from the two-dimensional ion trap, ions having a mass-to-charge ratio within a second range of values that is narrower than the first range of values, such that the ejected ions propagate along a plurality of different trajectories, each different trajectory originating within the curved trapping region and between the two opposite ends thereof, and each trajectory being directed generally toward an ion inlet of a collision cell that is disposed adjacent to the two-dimensional ion trap;

c) collisionally dissociating at least a portion of the ejected ions within the collision cell, so as to produce product ions; and, d) using a mass analyzer, obtaining a mass spectrum of the product ions.

19. A method according to claim 18, comprising a step of repeating steps b) through d) for each of a plurality of different second ranges of mass-to-charge values, so as to eject sequentially substantially all of the ions within the first range of values.

20. A method according to claim 19, wherein the mass spectrum of the product ions is obtained at a rate of at least 500,000 amu per second.

21. A method according to claim 19, wherein the mass spectrum of the product ions is obtained at a rate of at least 1,000,000 amu per second.

* * * * *